US006651721B2

(12) United States Patent
Allsopp

(10) Patent No.: US 6,651,721 B2
(45) Date of Patent: Nov. 25, 2003

(54) METHOD AND APPARATUS FOR OPERATING A BLIND

(75) Inventor: Reginald Charles Allsopp, Stockport (GB)

(73) Assignee: Louver-Lite Limited, Hyde (GB)

( * ) Notice: Subject to any disclaimer, the term of this patent is extended or adjusted under 35 U.S.C. 154(b) by 0 days.

(21) Appl. No.: 09/944,084

(22) Filed: Sep. 4, 2001

(65) Prior Publication Data

US 2002/0062931 A1 May 30, 2002

(30) Foreign Application Priority Data

Nov. 24, 2000 (GB) ..... 0028664

(51) Int. Cl.[7] ..... E06B 9/30
(52) U.S. Cl. ..... 160/168.1 V; 160/177 V
(58) Field of Search ..... 160/168.1 V, 173 V, 160/174 V, 176.1 V, 177 V, 177 R, 900

(56) References Cited

U.S. PATENT DOCUMENTS 4,257,470 A * 3/1981 Woodle ..... 160/172
4,386,644 A * 6/1983 Debs ..... 160/174
4,531,715 A * 7/1985 Wiens ..... 254/266
4,586,696 A * 5/1986 Mugford et al. ..... 254/122
4,607,974 A * 8/1986 Brothers et al. ..... 403/24
4,928,547 A * 5/1990 Huyer ..... 74/545
5,038,843 A * 8/1991 Sommerfeld ..... 160/176.1
5,407,008 A * 4/1995 Boloix ..... 160/177
5,421,180 A * 6/1995 Rojdev ..... 70/456 R
5,472,035 A * 12/1995 Biba et al. ..... 160/168.1
5,603,371 A * 2/1997 Gregg ..... 160/176.1
5,657,807 A * 8/1997 Hsu ..... 160/178.1
5,771,953 A * 6/1998 Benthin ..... 160/168.1 V
5,845,695 A 12/1998 Cadorette et al. ..... 160/173 V
5,848,632 A * 12/1998 Chou ..... 160/168.1 V
5,937,928 A * 8/1999 Chou ..... 160/168.1 V
5,950,701 A * 9/1999 Rogers ..... 160/177 V
5,964,637 A * 10/1999 Hardaway ..... 446/246
6,298,897 B1 * 10/2001 Metcalf et al. ..... 160/177 R

FOREIGN PATENT DOCUMENTS

CH 649811 6/1985
JP 10 102943 4/1998

* cited by examiner

*Primary Examiner*—Bruce A. Lev
(74) *Attorney, Agent, or Firm*—Dennison, Schultz & Dougherty

(57) ABSTRACT

An apparatus for operating a vertical louver blind having a plurality of louver carrier trucks slidably mounted within a headrail, wherein each of the carrier trucks includes a louver carrier which is mounted for rotation about a vertical axis, and an operating wand which is selectively engageable with first or second transmissions at any given time.

6 Claims, 1 Drawing Sheet

METHOD AND APPARATUS FOR OPERATING A BLIND

The present invention relates to an apparatus for operating a blind, in particular, but not exclusively, a vertical window blind, and also to a method of operating such a blind using the apparatus.

BACKGROUND OF THE INVENTION

It is known to provide a vertical louver blind comprising a plurality of louver carrier trucks constrained to move longitudinally within a headrail. Typically, each truck includes a louver carrier which is rotatable about a vertical axis. In such known vertical louver blinds, translational movement of the carrier trucks is effected by a first drive means and a rotation of the vertical louvers carried by respective louver carriers is effected by a second separate drive means. Each of the two drive means includes a respective operating apparatus whereby a user can control the operation of the drive means. Thus, conventional vertical louver blinds have two separate controls for arranging the blind in the desired configuration, which at best detracts from the aesthetic appeal of the blind, and at worst can be confusing for a user as to which operating apparatus has which effect, thus leading to frustration on the part of the user.

Accordingly, it is desired to provide a vertical louver blind with a simplified operating means.

SUMMARY OF THE INVENTION

Thus, in accordance with a first aspect of the present invention, there is provided a vertical blind assembly including a plurality of louver carrier trucks slidably carried within a headrail, each truck including a louver carrier mounted for rotation about an axis; wherein the blind assembly further includes an operating means selectively engageable with a first drive means for urging the trucks to move lengthwise within the headrail and a second drive means for rotation of the louver carrier of each truck about its respective axis.

Embodiments of the present invention thus only require a single operating means for the control of both the translational movement of the trucks along the headrail and the rotational movement of the louver carriers about their respective axes.

The operating means preferably comprises an operating wand.

Preferably, the operation of the vertical blind is caused by rotation of the relevant drive means, which in turn is effected by rotation of the wand when engaged with that drive means.

In a preferred embodiment, the wand includes an engagement element and each of the first and second drive means includes a receiving portion arranged to be capable of receiving at least a portion of the engagement element, whereby the desired drive may be achieved by interengagement of the engagement element, or a portion thereof, with the first or second drive receiving portion.

The wand desirably includes an upper wand portion which carries the engagement element, the engagement element being disengaged from one of the drive means and engaged with the other of the drive means via axial movement of the upper wand portion.

The first drive means may include a chain wheel capable of driving a chain which is preferably connected either directly or indirectly to at least one of the trucks for causing longitudinal movement of the or each truck within the headrail. The term "chain" is intended to include a cord comprising a plurality of equally spaced balls or spheres attached to the cord, as is conventially used with this type of blind assembly. Each louver carrier truck may be connected to the truck or trucks adjacent to it, and the chain may be connected to one of the trucks (the "lead" truck) such that movement of the lead truck longitudinally within the headrail results in the remainder of the louver carrier trucks either being pulled along behind it or pushed by it in the desired direction. This type of arrangement results in the simple and effective control of the movement of the louver carrier trucks within the headrail.

The second drive means preferably includes a generally cylindrical sleeve carrying an external worm gear. A common drive rod preferably cooperates with the louver carrier of each truck and carries a gear wheel which is meshed with the external worm gear of the sleeve such that rotation of the sleeve causes rotation of the drive rod via the gear wheel. This in turn results in rotation of each of the louver carriers.

The operating wand preferably includes at least one hinge to enable a user more easily to rotate the wand. More preferably, the operating wand includes two hinges and is arrangeable in the form of a crank.

In accordance with a second aspect of the present invention there is provided a method of operating a vertical blind apparatus according to the first aspect of the invention, the method including engaging the operating means with the first or second drive means and energising the engaged drive means to cause the desired movement of the louvers. Thus, if it is desired to effect translational movement of the carrier trucks along the headrail, then the first drive means is engaged and energised. Alternatively, if it is desired to rotate the louvers about their respective axes, then the second drive means is engaged and energised.

An embodiment of the present invention will now be described, by way of example only, with reference to the accompanying drawing which shows an exploded view of one end of a vertical louver blind headrail assembly.

For the avoidance of doubt, it should be noted that in the following description, references to "up", "down" and to related terms, refer to the orientation that the relevant component(s) of the blind adopt when installed for normal use, as they are shown in the drawing.

DETAILED DESCRIPTION OF THE INVENTION

Figure 1:
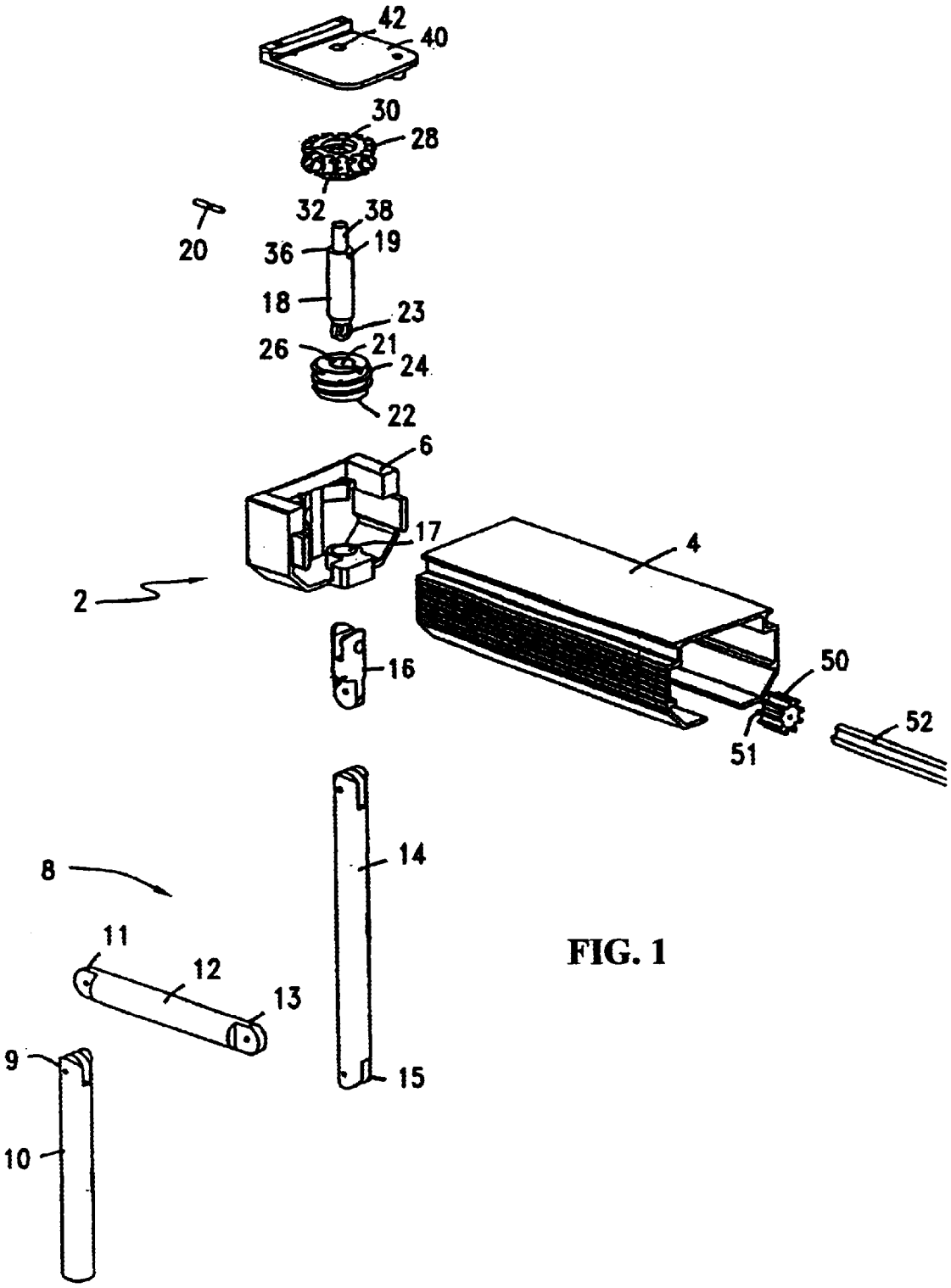
FIG. 1 illustrates an embodiment of the first aspect of the invention, namely a vertical blind headrail assembly 2 including a headrail 4, an end cap 6 and an operating wand 8.

The operating wand 8 includes a lower wand portion 10 hingeably coupled at one end 9 to a first end 11 of an intermediate wand portion 12. The other end 13 of the intermediate wand portion 12 is likewise hingeably coupled to a first end 15 of an upper wand portion 14. This arrangement of upper wand portion 14, intermediate wand portion 12 and lower wand portion 10 allows the wand to be arranged in the form of a crank, as shown in the drawing, which permits easier rotation of the wand 8.

The upper wand portion 14 is connected at its other end to a wand operating element 18 via a universal joint element 16 which is common in wand-operated drive apparatus.

The operating element 18 includes an engagement pin 20 which is friction fitted within an aperture 19 through the operating element 18 such that both ends of the engagement pin 20 project beyond the outermost cylindrical surface of the operating element 18.

The operating element 18 includes towards its upper end a shoulder 36 and extending axially from the shoulder 36 a cylindrical projection 38 having a diameter smaller than the diameter of the main body of the operating element 18.

Upon assembly of the headrail apparatus, the operating element 18 is located within a through hole 17 in the base of the end cap 6 whereby a connecting portion 23 of the operating element 18 extends beyond the through hole 17 and is hingeably connected to one end of the universal joint element 16. The main body of the operating element 18 is sized such that it is axially slidably within the through hole 17. A cylindrical sleeve 22 having a bore 21 of diameter substantially equal to that of the diameter of the through hole 17 is then arranged such that the bore 21 surrounds a portion of the operating element 18 and is arranged substantially coaxially with the through hole 17. The length of the bore 21 is less than the length of the main body of the operating element 18 and the operating element can slide axially within the bore 21. The cylindrical sleeve 22 carries on its outer cylindrical surface an external worm gear 24. It also includes a pair of channels 26 coaxially arranged on the upwardly facing surface of the sleeve 22 on opposite sides of the bore 21.

The engagement pin 20 is then friction fitted within the through hole 19 with its opposite end portions extending therefrom. The channels 26 are arranged to be capable of receiving the projecting end portions of the engagement pin 20.

A top plate 40 covers an upper portion of the end cap 6 and an aperture 42 through the top plate 40 receives an upper end portion of the projection 38 of the operating element 18 such that the projection 38 acts as a journal borne within the aperture 42.

The top plate 40 also has rotatably coupled thereto a chain wheel 28, which includes a cylindrical bore 30. The cylindrical bore 30 is arranged to be substantially coaxial with the aperture 42 and the projection 38, and is sized to receive therewithin a portion of the projection 38. The chain wheel 28 also includes on its downwardly facing end surface a pair of channels (not shown) corresponding to channels 26 in the upwardly facing end surface of the cylindrical sleeve 22.

The louver blind headrail assembly 2 further includes a metal drive rod 52 which extends the length of the headrail 4 passing through each of the louver carriers (not shown). The drive rod 52 carries at one end thereof a gear wheel 50 having on its outwardly facing cylindrical surface a plurality of teeth 51. The gear wheel 50 is rotatably coupled to the end cap 6 such that the teeth 51 mesh with the external worm gear 24, whereby rotation of the cylindrical sleeve 22 results in a corresponding rotation of the metal drive rod 52. This in turn co-operates with a torque transfer apparatus within each louver carrier truck to rotate the louver carrier about a vertical axis, thus rotating a louver suspended from the louver carrier.

In use, to move the carrier trucks longitudinally within the headrail 4, the upper wand portion 14 of the operating wand 8 is moved axially upwards until the engagement pin 20 engages with the downwardly facing channels (not shown) formed in the chain wheel 28. The wand is then rotated and a cord carrying a plurality of equally spaced plastic balls (not shown) is driven to rotate by virtue of jaws 32 of the chain wheel 28 engaging with respective plastic balls on the chain. The chain is connected to the lead, louver truck (not shown) which is caused to move longitudinally within the headrail 4 in a direction which is dependent upon the sense (i.e. clockwise or anti-clockwise) in which the chain wheel is rotated by the operating wand 8. The remaining trucks are either pulled or pushed by the lead truck, depending upon the direction in which the lead truck is moved.

Alternatively, if a user desires to rotate each louver about its vertical axis, then the upper wand portion 14 of the operating wand 8 is moved axially downwards until the projecting ends of the engagement pin 20 engage within the channels 26 of the sleeve 22 and the operating wand is then again rotated in the desired sense. The external worm gear 24 is meshed with the teeth 51 of the gear wheel 50 and rotation of the cylindrical sleeve 22 results in rotation of the drive rod 52 via the external worm gear 24 and the gear wheel 50. The rotation of the drive rod 52 results in the rotation about a respective vertical axis of the louvers carried by the carrier trucks. Again, the direction or sense of the rotation is determined by the direction or sense in which the operating wand is rotated.

This preferred embodiment has been described by way of an example only and it will be apparent to those skilled in the arts that many alterations can be made that are still within the scope of the invention.

What is claimed is:

1. A vertical blind apparatus including a plurality of trucks slidable within a headrail, each of said plurality of trucks including a louver carrier mounted thereon for rotation about an axis, comprising:

an operating wand, wherein said operating wand includes an engagement pin;

a first transmission; and, a second transmission, wherein said operating wand is movable from a first position wherein said engagement pin operably engages said first transmission for urging the plurality of trucks to move lengthwise within the headrail, and said operating wand is movable to a second position wherein said engagement pin operably engages said second transmission to rotate the louver carriers about said axis.

2. A vertical blind apparatus according to claim 1, wherein the operating wand includes an upper wand portion which carries the engagement pin.

3. A vertical blind apparatus according to claim 1, wherein the first transmission includes a chain wheel capable of driving a chain connected to at least one of the louver carrier trucks.

4. A vertical blind apparatus according to claim 1, wherein the second transmission includes a substantially cylindrical sleeve having a threaded outer surface.

5. A vertical blind apparatus according to claim 1, wherein the wand includes a hinge connecting a first wand portion to a second wand portion.

6. A vertical blind apparatus according to claim 5, wherein the wand includes two hinges and is arrangeable in the form of a crank.

* * * * *